US011318339B2

(12) United States Patent
Walsh et al.

(10) Patent No.: US 11,318,339 B2
(45) Date of Patent: May 3, 2022

(54) DIVING BOARD STAND

(71) Applicant: Duraflex International Corp., Sparks, NV (US)

(72) Inventors: Matthew Walsh, Sparks, NV (US); Mark Spry, Sparks, NV (US)

(73) Assignee: DURAFLEX INTERNATIONAL CORP., Sparks, NV (US)

( * ) Notice: Subject to any disclaimer, the term of this patent is extended or adjusted under 35 U.S.C. 154(b) by 0 days.

(21) Appl. No.: 16/753,982

(22) PCT Filed: Oct. 5, 2018

(86) PCT No.: PCT/US2018/054679

§ 371 (c)(1),
(2) Date: Apr. 6, 2020

(87) PCT Pub. No.: WO2019/071173

PCT Pub. Date: Apr. 11, 2019

(65) Prior Publication Data

US 2020/0391066 A1 Dec. 17, 2020

Related U.S. Application Data

(60) Provisional application No. 62/569,247, filed on Oct. 6, 2017.

(51) Int. Cl.
*A63B 5/10* (2006.01)

(52) U.S. Cl.
CPC ..... *A63B 5/10* (2013.01); *A63B 2244/203* (2013.01)

(58) Field of Classification Search
CPC ..... A63B 5/10; A63B 2244/203; A63B 5/00; A63B 5/08; A63B 5/085; A63B 2244/206
See application file for complete search history.

(56) References Cited

U.S. PATENT DOCUMENTS

| | | | | | |
|---|---|---|---|---|---|
| 2,032,574 | A | | 3/1936 | Handley | |
| 2,106,068 | A | | 1/1938 | Sirch | |
| 2,112,315 | A | | 3/1938 | Townsend | |
| 2,812,180 | A | * | 11/1957 | Cymbal | A63B 5/10 482/31 |
| 3,030,108 | A | * | 4/1962 | Baker | A63B 5/10 482/32 |
| 3,072,401 | A | * | 1/1963 | Rude | A63B 5/10 482/32 |

(Continued)

FOREIGN PATENT DOCUMENTS

| | | |
|---|---|---|
| FR | 2479695 A1 | 10/1981 |
| GB | 646883 | 11/1950 |

OTHER PUBLICATIONS

International Preliminary Report on Patentability, PCT/US2018/054679, dated Apr. 8, 2020, 7 pages.

(Continued)

*Primary Examiner* — Joshua Lee
*Assistant Examiner* — Catrina A Letterman
(74) *Attorney, Agent, or Firm* — Stinson LLP

(57) ABSTRACT

A diving board stand comprising a fulcrum base, a fulcrum roller configured to be supported over the fulcrum base and movable on the fulcrum base, a rear anchor for connecting the diving board stand to a rear end of a diving board, and an alignment beam for connecting the fulcrum base to the rear anchor.

11 Claims, 25 Drawing Sheets

(56) References Cited

U.S. PATENT DOCUMENTS

| | | | | | |
|---|---|---|---|---|---|
| 3,083,965 | A | | 4/1963 | Jewett | |
| 3,321,204 | A | * | 5/1967 | Pretti | A63B 5/10 482/32 |
| 3,342,483 | A | | 9/1967 | Erickson | |
| 3,372,927 | A | * | 3/1968 | Rude | A63B 5/10 482/32 |
| 3,373,990 | A | * | 3/1968 | Riniker | A63B 5/10 482/32 |
| 3,403,880 | A | * | 10/1968 | Rude | A63B 5/10 248/346.03 |
| 3,856,296 | A | * | 12/1974 | Fischer | A63B 5/10 482/31 |
| 4,017,069 | A | | 4/1977 | Daly et al. | |
| 5,326,336 | A | * | 7/1994 | Wemlinger | A63B 5/10 254/3 R |

OTHER PUBLICATIONS

International Search Report and Written Opinion issued for PCT/US2018/054679 dated Dec. 7, 2018, 8 pages.
Supplementary European Search Report, European Appl. No. 18864371.2, dated May 26, 2021, 8 pages.
Office Action, Chinese Application No. 201880075103.0, dated Jan. 27, 2021, 9 pages.

* cited by examiner

DIVING BOARD STAND

REFERENCE TO RELATED APPLICATIONS

This is a U.S. national stage application based on PCT application PCT/US2018/054679 filed Oct. 5, 2018 and claims priority to application U.S. Provisional application No. 62/569,247, filed Oct. 6, 2017, the entire disclosures of which are incorporated herein by reference.

FIELD OF THE INVENTION

The present invention generally relates to a diving board stand of the type for use in a diving board assembly comprising an elongate diving board, a diving board stand to which the board is attached at its base end, and a fulcrum.

BACKGROUND OF THE INVENTION

Conventional diving boards used in diving competitions (e.g., collegiate diving, the Olympic Games) are generally aluminum alloy boards coated with a non-skid surface material. Diving boards that have long been in use in such competitions are described, for example, in U.S. Pat. No. 4,303,238.

Diving board assemblies for use in competitive diving typically have an adjustable fulcrum so that the fulcrum can be adjusted to various positions along the length of the board to adjust the board stiffness. A competitive diving stand contains a moveable fulcrum, allowing the diver to adjust the amount of spring. The fulcrum system includes an adjustable wheel that sits beneath the board, and can be moved, e.g., 12 inches forward or backward from the mid-point, e.g., 24-inches in total. This adjustment changes the point at which the springboard will flex. Other than the hinges, the fulcrum is the only point of contact for the diving board and the stand. The fulcrum is important because it allows the diver to adjust the amount of spring, depending on the diver's weight and skill level. More spring does not necessarily correspond to more height. A diver must adjust the fulcrum so that he or she can push down on the board as it is going down, a technique known as riding the board. One such assembly is the Durafirm diving stand available from Duraflex International Corp. of Sparks, Nev., USA.

SUMMARY OF THE INVENTION

Briefly, therefore, the present invention is directed to a diving board stand assembly including an adjustable fulcrum.

In one aspect, the invention is directed to a diving board stand comprising a fulcrum base, a fulcrum roller configured to be supported over the fulcrum base and movable on the fulcrum base, a rear anchor for connecting the diving board stand to a rear end of a diving board, and an alignment beam for connecting the fulcrum base to the rear anchor.

In another aspect, the invention is directed to a diving board stand comprising a fulcrum base, a fulcrum roller configured to be supported over the fulcrum base and movable on the fulcrum base, a fulcrum carriage for supporting the fulcrum roller on the fulcrum base, a rear anchor for connecting the diving board stand to a rear end of a diving board, and an alignment beam for connecting the fulcrum base to the rear anchor; wherein the rear anchor comprises hinges for hingedly securing a diving board to the rear anchor; and the fulcrum carriage comprises guides for riding on vertically projecting rails of the fulcrum base for guiding the fulcrum along the fulcrum base.

The invention is also directed to other combinations and subcombinations based on the below description and/or attached drawings.

Other objects and features of the invention will be apparent from the below.

BRIEF DESCRIPTION OF THE DRAWINGS

Corresponding reference characters indicate corresponding parts throughout the drawings.

DETAILED DESCRIPTION OF THE PREFERRED EMBODIMENTS

Figure 1:
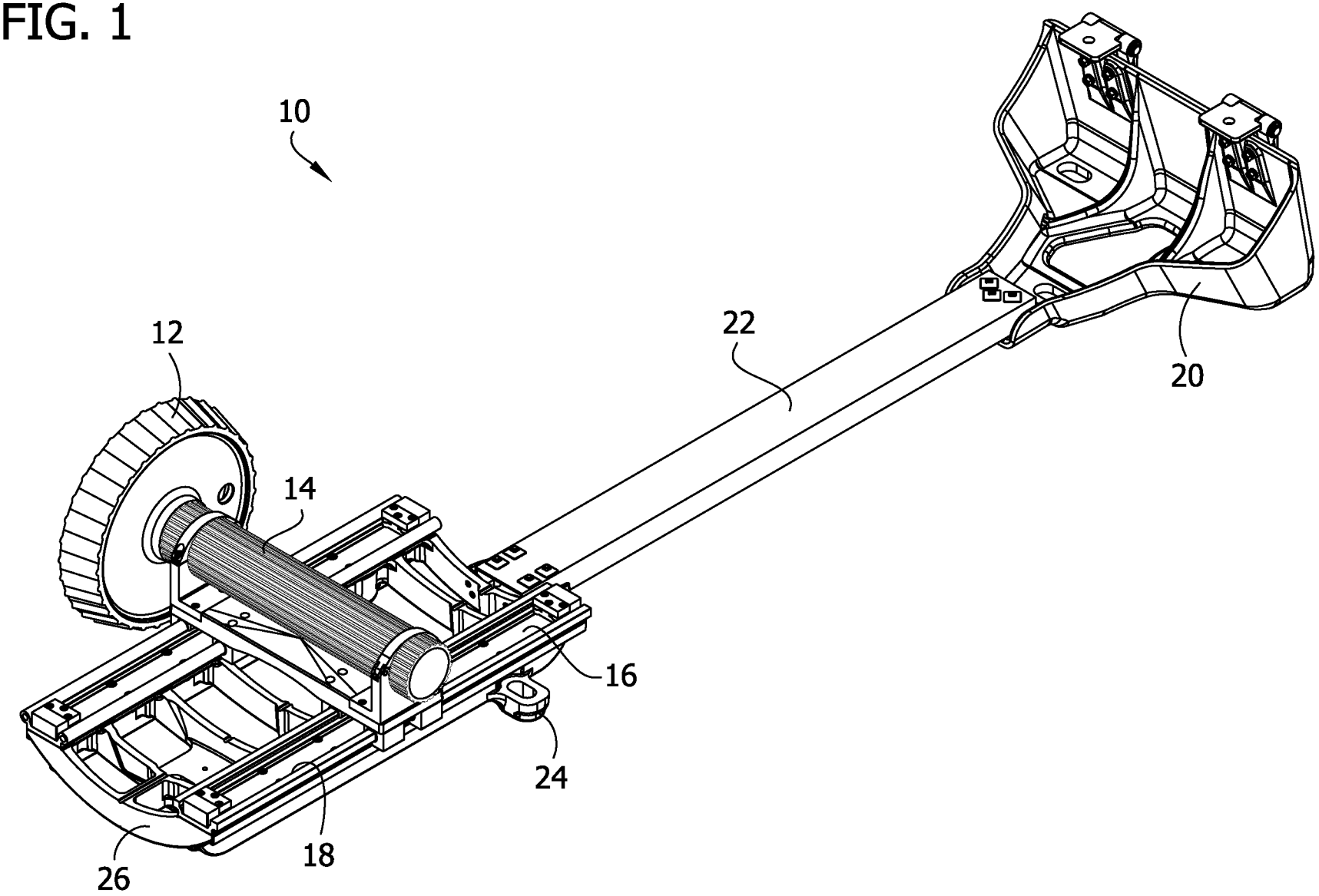
FIG. 1 is a perspective view of the diving board stand of the invention.
Figure 2:
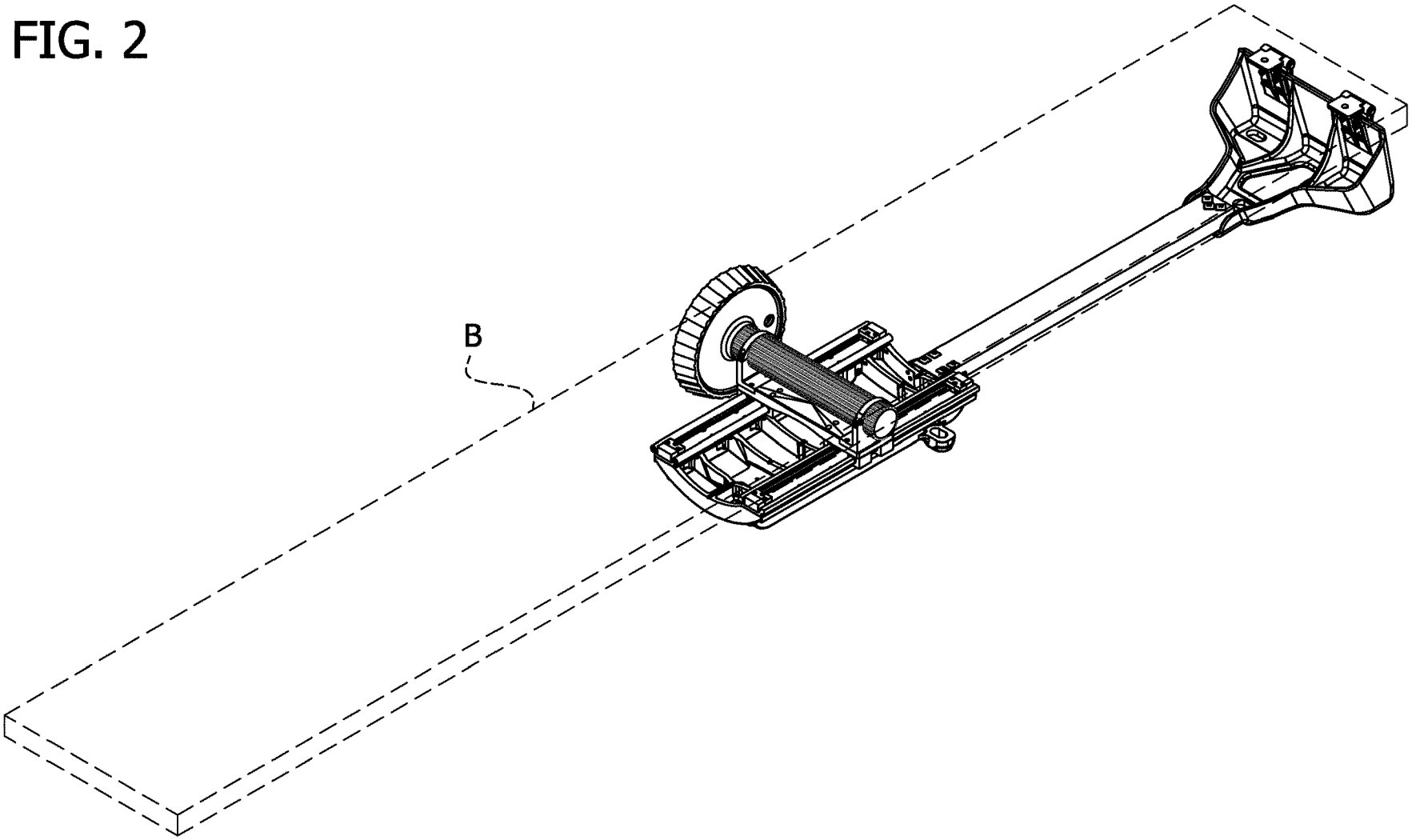
FIG. 2 is a perspective view of the diving board stand with a diving board shown in phantom to illustrate how board rests on the stand.
Figure 3:
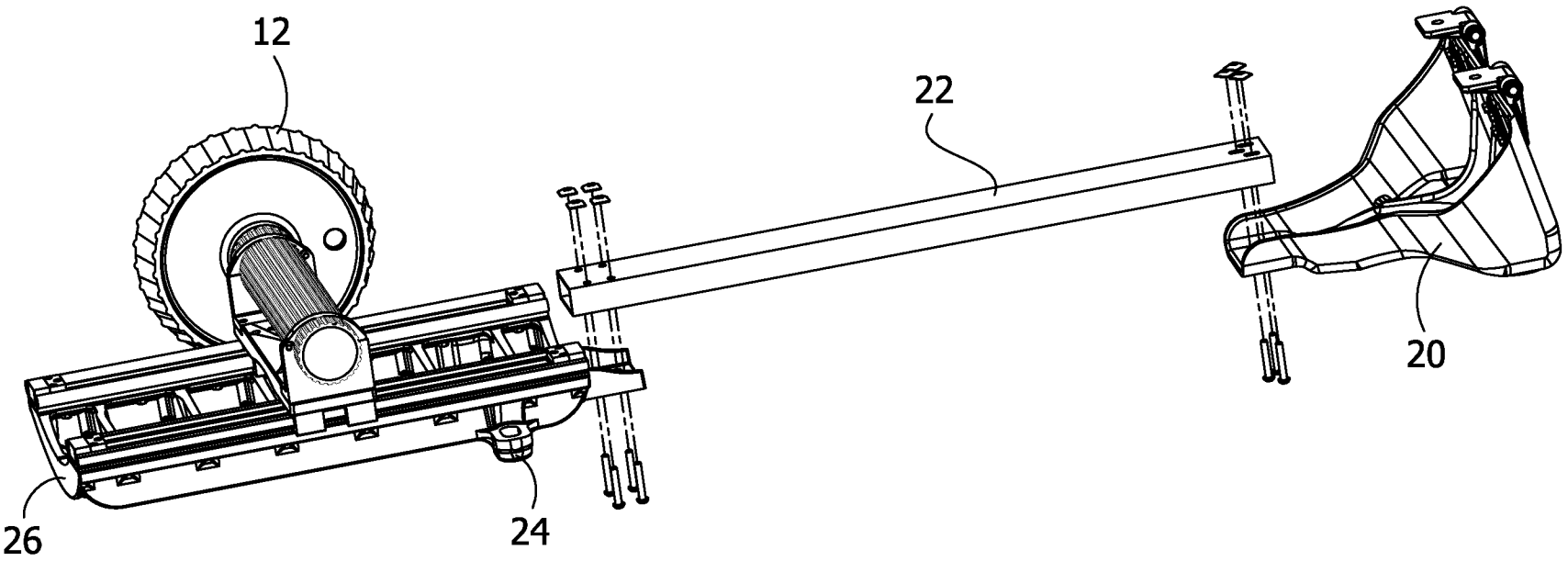
FIG. 3 is a partially exploded perspective view of the diving board stand.
Figure 18:
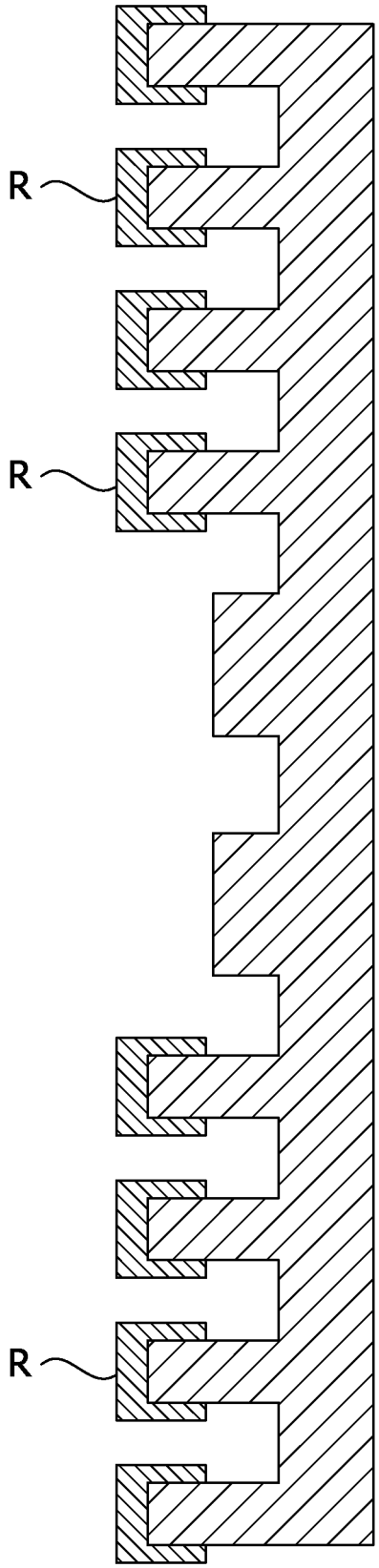
FIG. 18 is a cross section of a diving board of the type mounted to the diving board stand of the invention.

FIG. 1 shows the diving board stand 10 of the invention including an adjustment actuator 12 shown here as an actuator wheel. The actuator wheel 12 is connected to one end of fulcrum roller 14 and can be turned to roll the roller 14, which moves along linear track 16, which includes vertical track elements or rails 18. Linear track 16 maintains alignment and allows for smooth movement of the fulcrum including fulcrum roller 14. The grooves in fulcrum roller 14 gain traction on an underneath side of a diving board when a diving board B (FIG. 2) rests on the stand. Traction is facilitated by, for example, rubber strips R on the underneath side of the diving board as shown in FIG. 18. Since the board itself is anchored, turning the actuator wheel does not move the board; rather, it moves the fulcrum roller 14 linearly along linear track 16.

Figure 6:
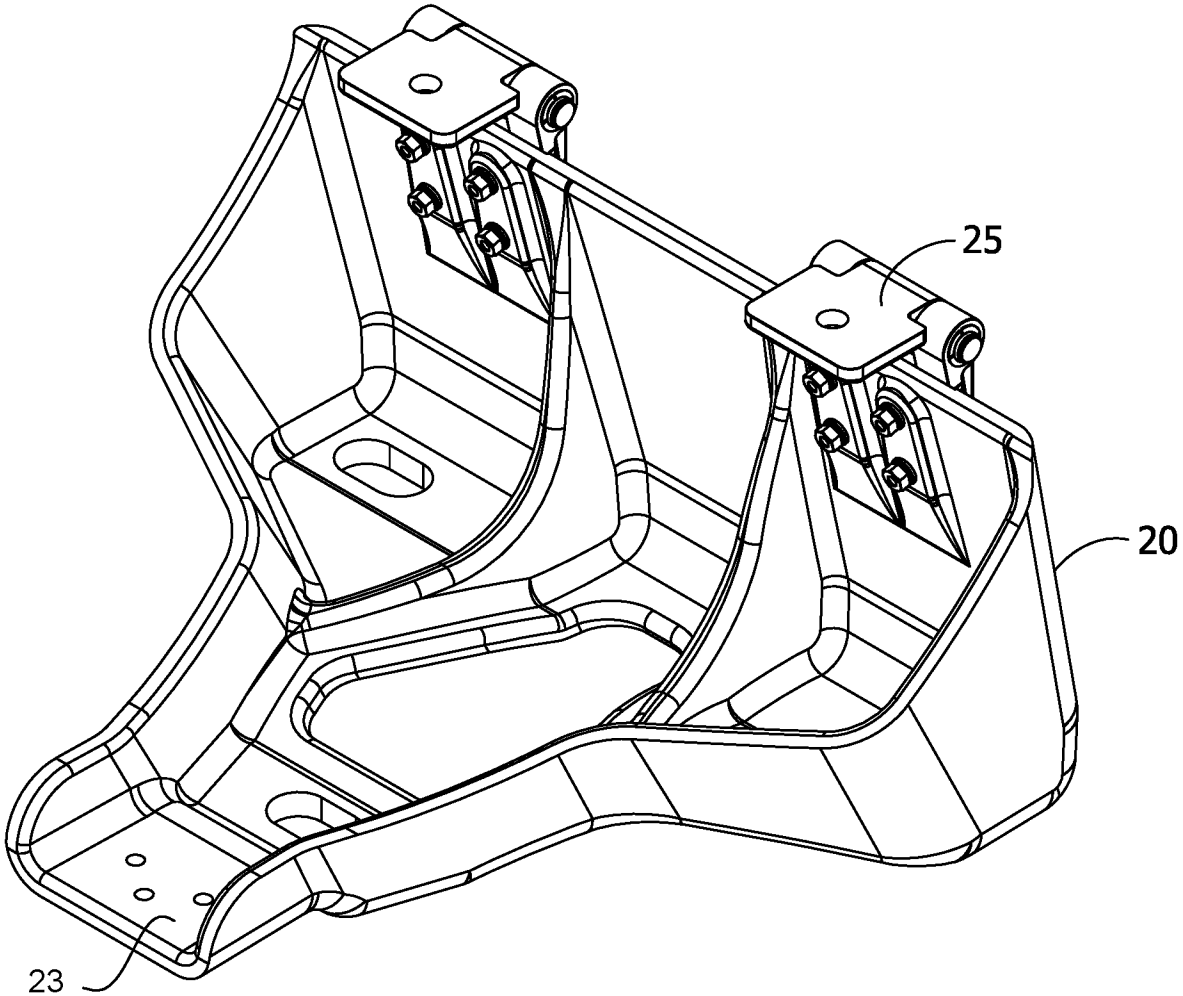
FIG. 6 is a perspective view of the anchor component of the diving board stand.
Figure 7:
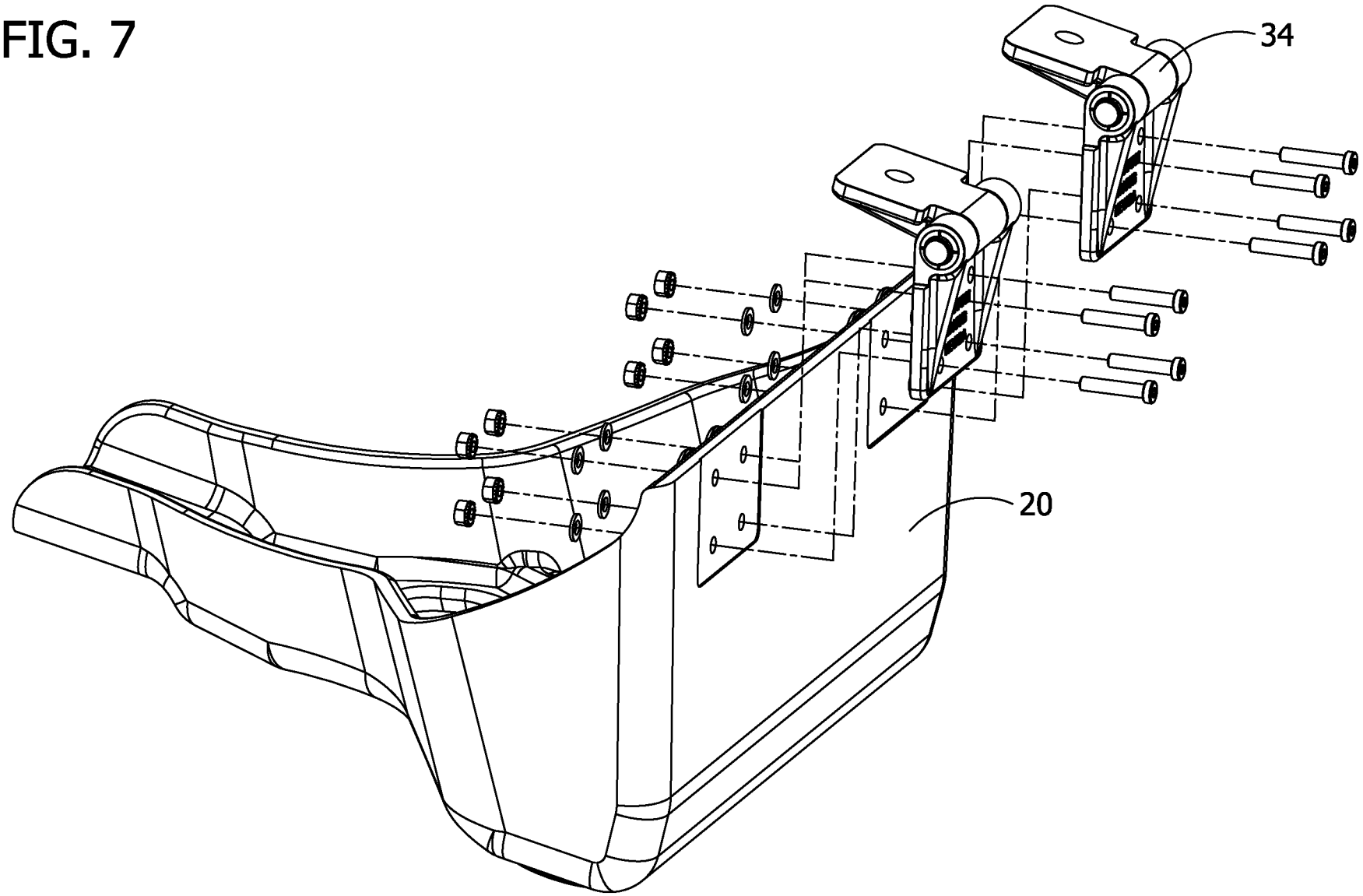
FIG. 7 is an exploded version of FIG. 6.
Figure 9:
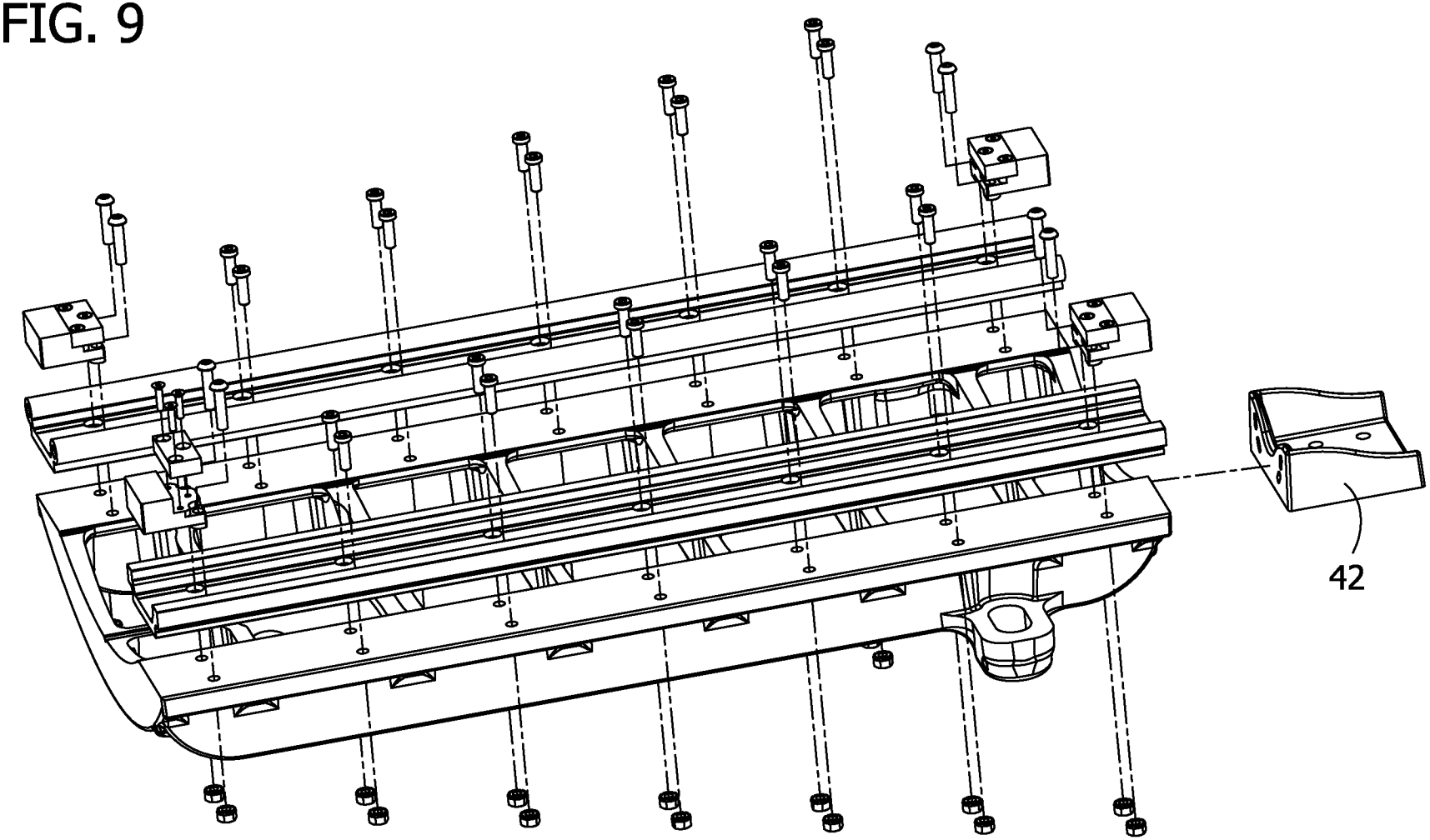
FIG. 9 is an exploded version of FIG. 8.
Figure 10:
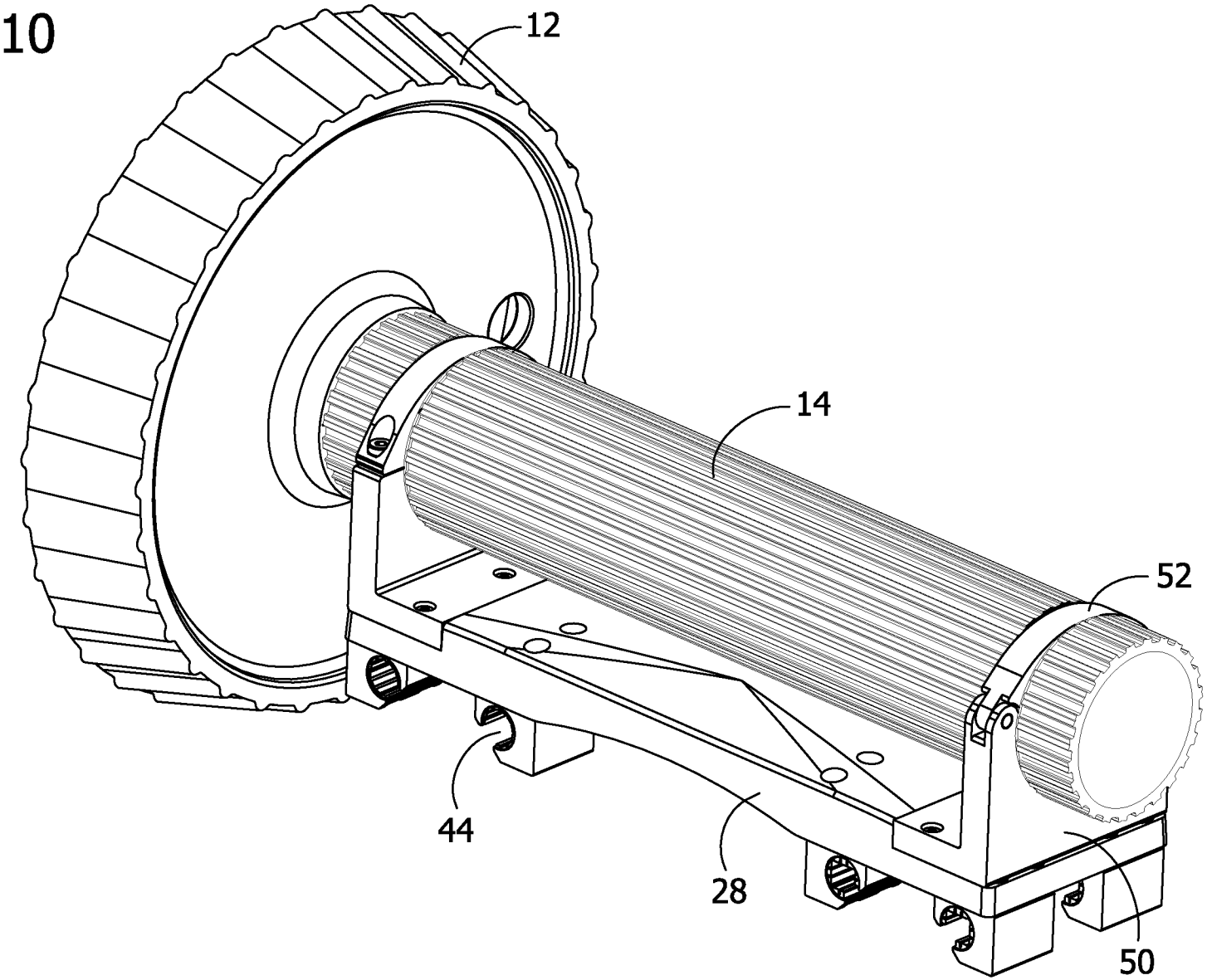
FIG. 10 is a perspective view of the fulcrum roller and fulcrum carriage assembly of the diving board stand.

Linear track 16 is mounted on fulcrum casting 26, which supports and allows for adjustment of the fulcrum roller 14. Fulcrum casting 26 is a fulcrum base and is fixedly connected to alignment beam 22 via alignment beam mounting bracket 42 (FIG. 9). Alignment beam 22 maintains alignment between the fulcrum assembly and rear anchor 20. Rear anchor 20 is preferably a metal brace which connects and anchors the overall fulcrum assembly to a diving board. In the preferred embodiment shown, the rear anchor 20 comprises a tray 23 (FIG. 6) into which the end of alignment beam 22 nests, and two or more hinges 25 which function with connectors such as bolts to fix the diving board to the anchor, while allowing the diving board to pivot up and down. Fulcrum base 26 includes a cast-in wing formation 24 which provides a point for attachment when mounting the stand to a pedestal or platform. The various components of the stand are preferably made of metal.

Figure 4:
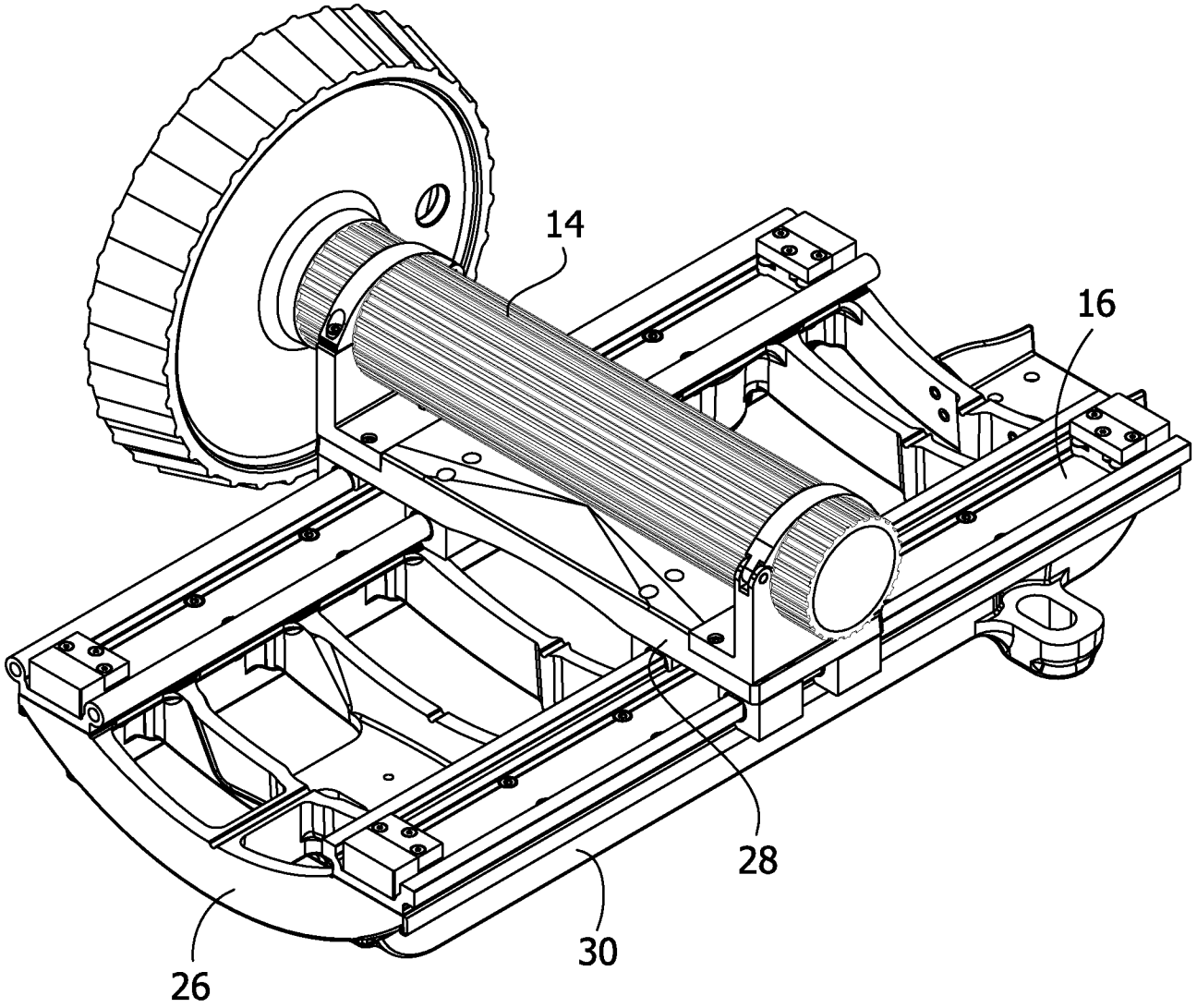
FIG. 4 is a perspective view of the fulcrum casting and fulcrum roller components of the diving board stand.
Figure 5:
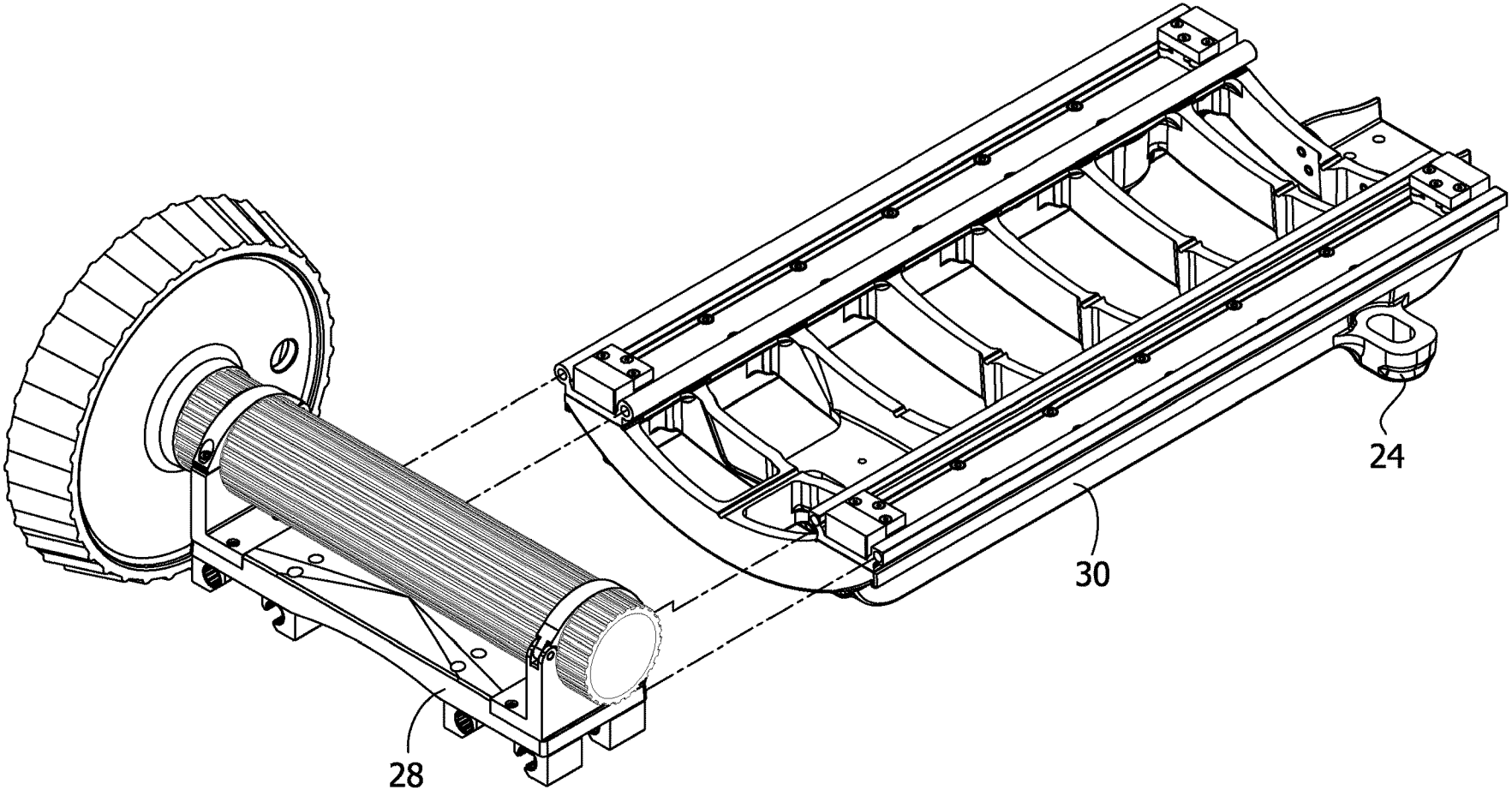
FIG. 5 is a perspective view similar to FIG. 4, with the roller separated from the fulcrum casting.

Fulcrum carriage assembly 28 (FIG. 4) supports fulcrum roller 14 and carries the roller along linear track 16. This assembly is an interface between the roller and the fulcrum casting. Overall fulcrum base assembly 30 includes the fulcrum casting 26 and the linear tracks.

Figure 8:
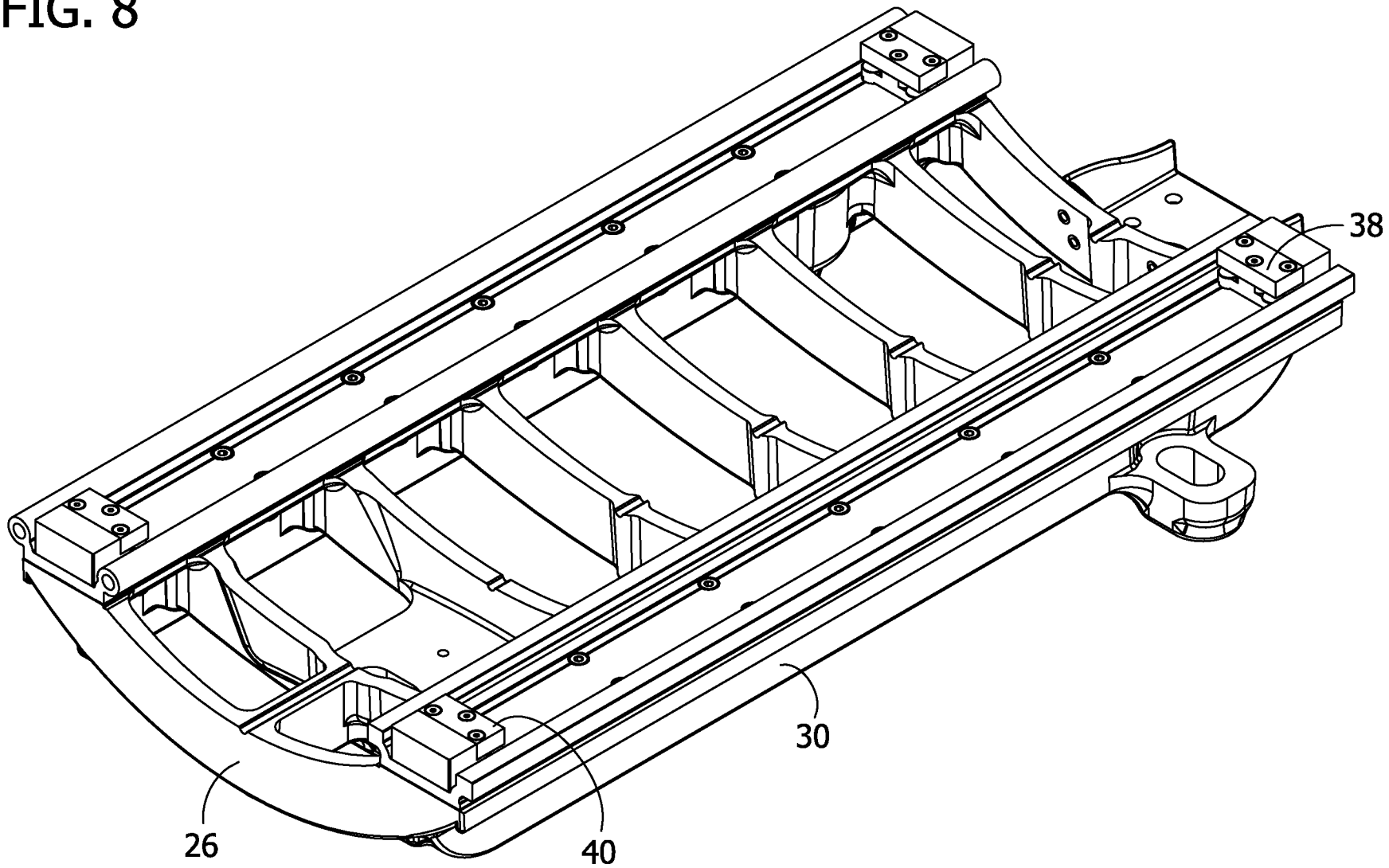
FIG. 8 is a perspective view of the fulcrum casting without the accompanying fulcrum roller and carriage assembly.
Figure 11:
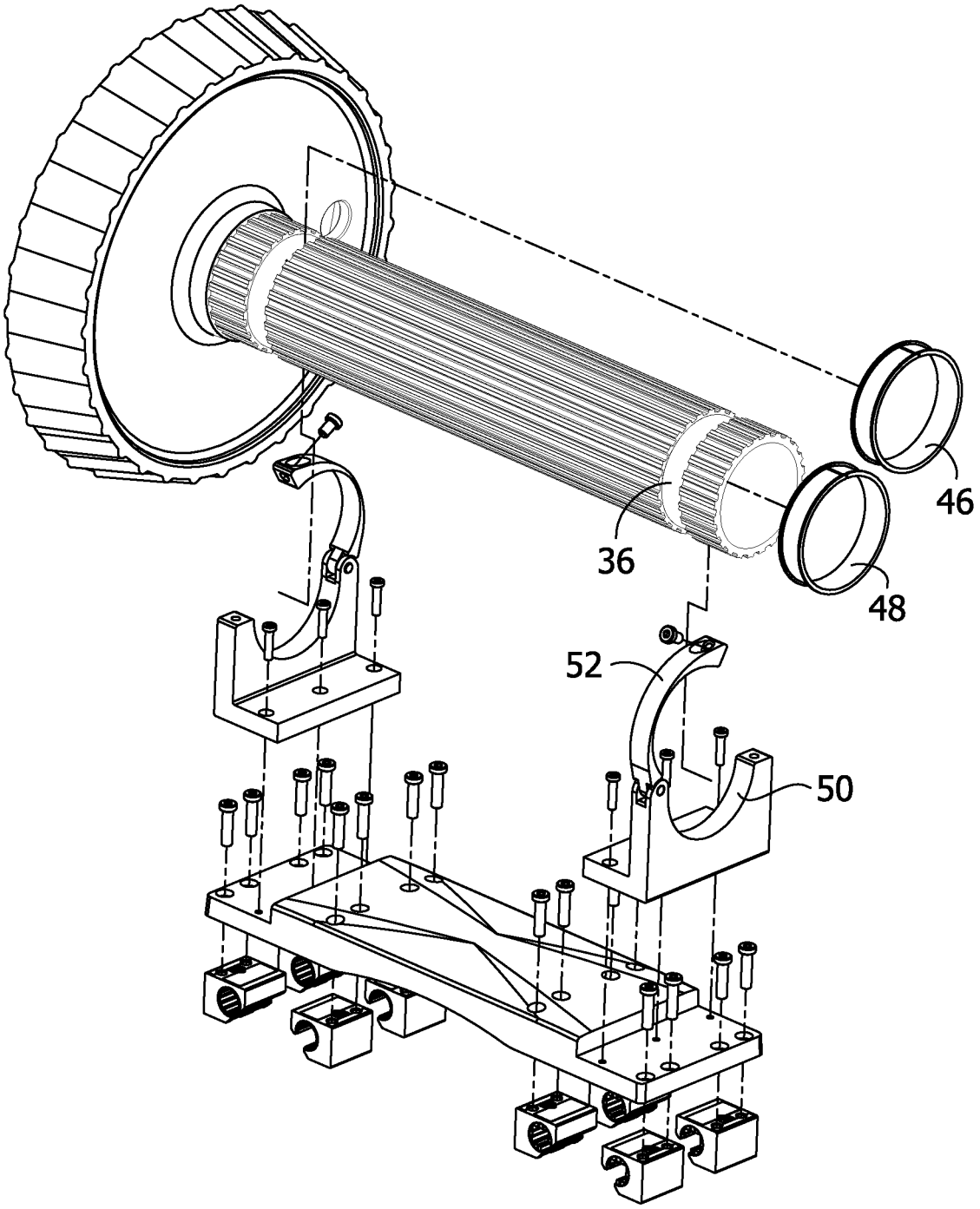
FIG. 11 is an exploded version of FIG. 10.
Figure 12:
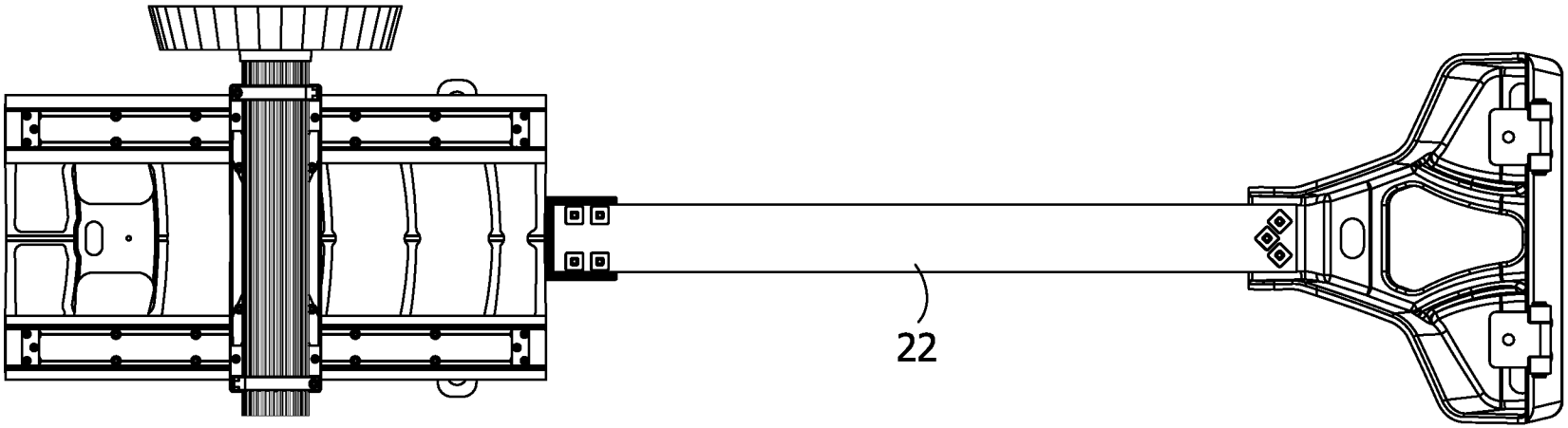
FIG. 12 is a top view of the diving board stand.
Figure 13:
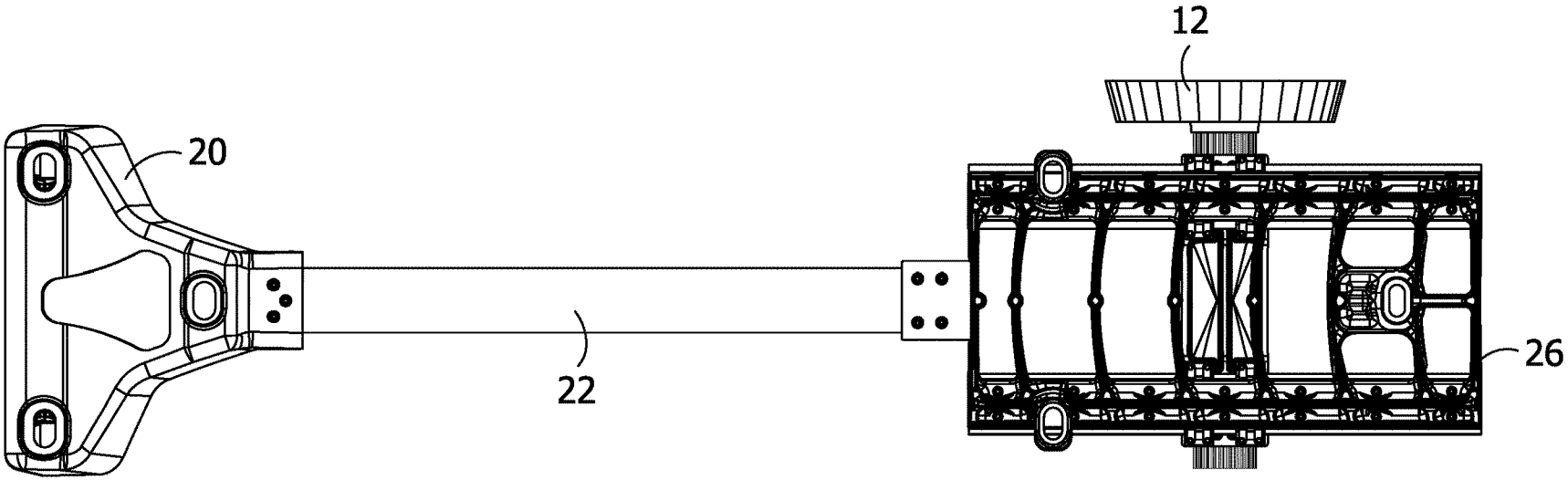
FIG. 13 is a bottom view of the diving board stand.
Figure 14:
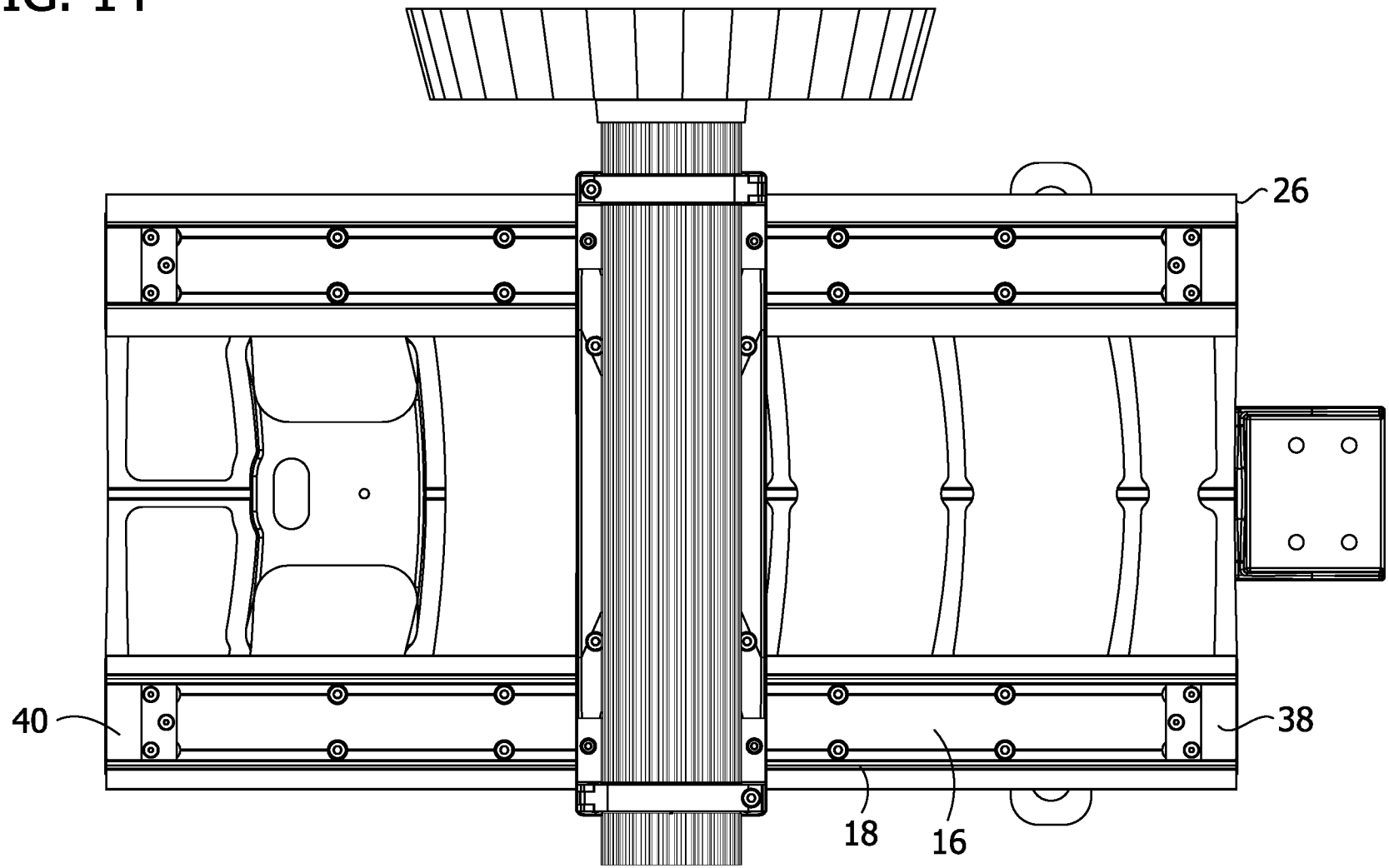
FIG. 14 is a top view of the fulcrum casting and fulcrum roller components.
Figure 15:
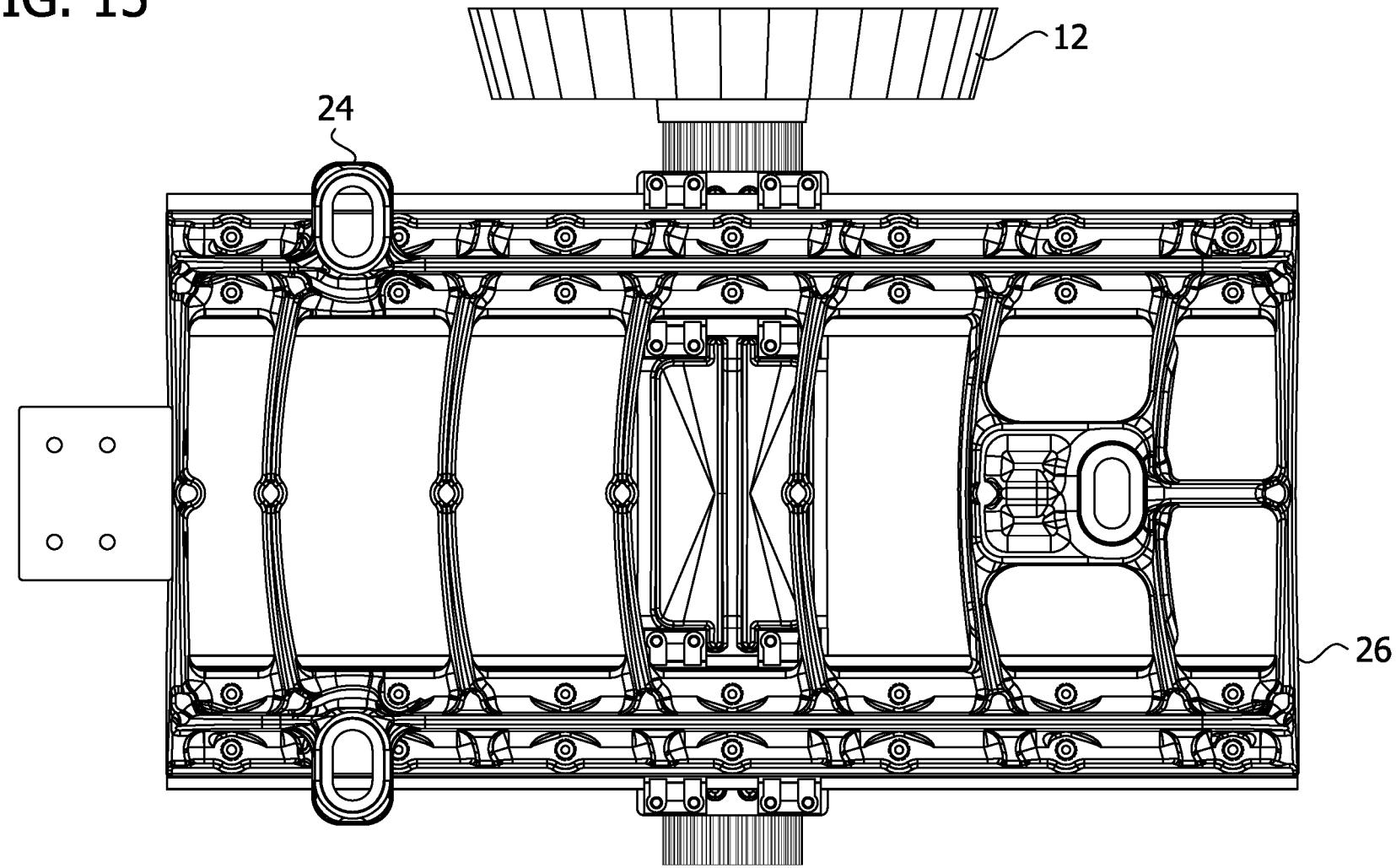
FIG. 15 is a bottom view of the fulcrum casting and fulcrum roller components.
Figure 16:
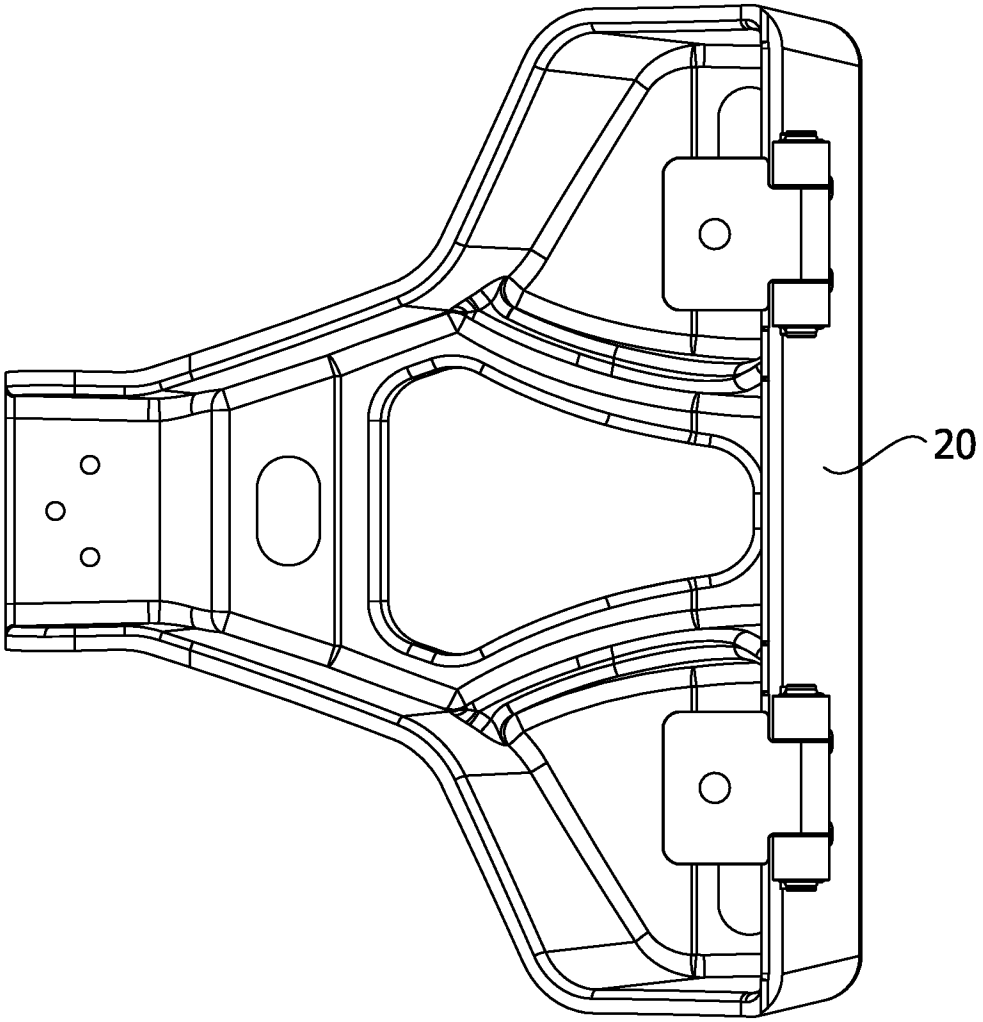
FIG. 16 is a top view of the anchor of the diving board stand.
Figure 17:
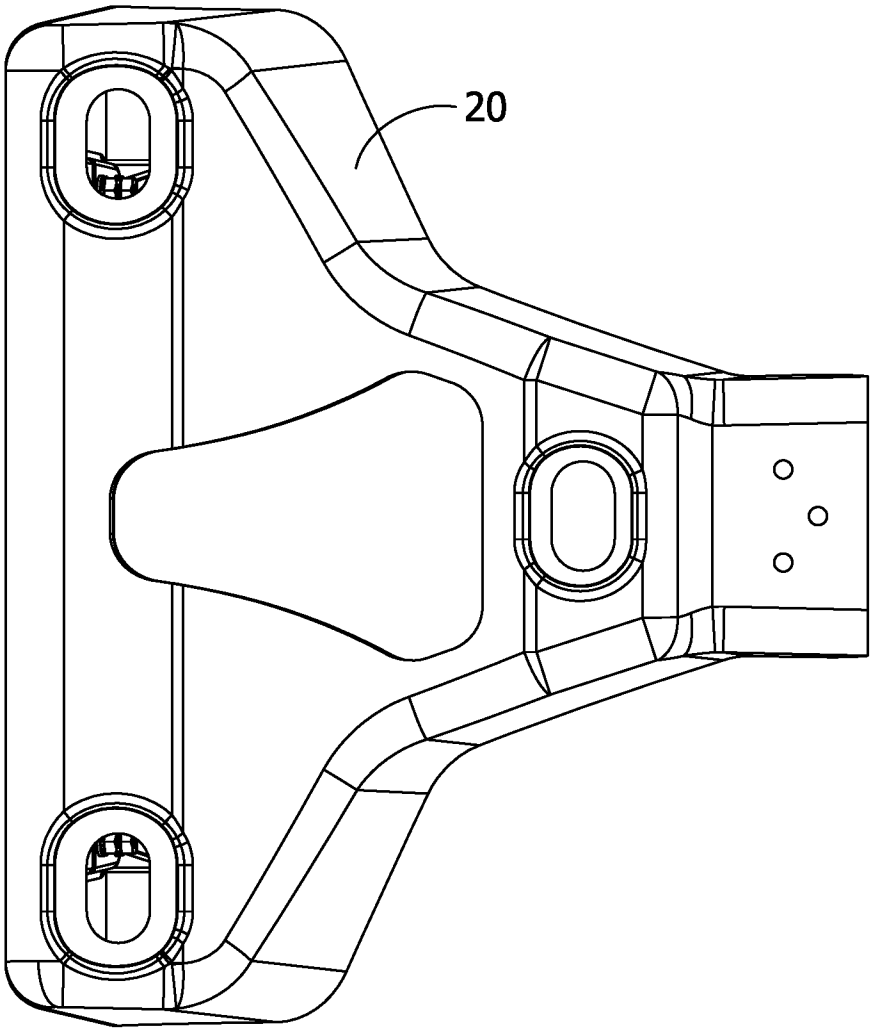
FIG. 17 is a bottom view of the anchor of the diving board stand

The fulcrum roller 14 has two circumferential recesses for receiving bearing sleeves 46 and 48 identified in FIG. 11. These sleeves are replaceable and interface between the rotating roller 14 and the non-rotating cradle elements 50, 52 in which roller 14 rests. The bearing sleeves sit in smooth-surfaced circumferential recesses 36 on the fulcrum roller as shown in FIG. 11. So the circumferential surface of the fulcrum roller is textured (here, e.g., with grooves) except in the area of the smooth-surfaced circumferential recesses. The cradle elements are attached to carriage assembly 28, which includes guides 44 that ride on vertical elements 18 of track 16. There are end stops 38 and 40 identified in FIG. 8 at each end of track 16 which limit the lengthwise movement of fulcrum carriage assembly 28 along track 16.

Alignment beam 22 at one end is connected to anchor 20 which connects the fulcrum assembly to a diving board. The embodiment shown includes diving board hinges 34 which allow the diving board to react to a dive while maintaining connection to the ground. Alignment beam 22 at its other end is connected to the fulcrum base assembly by alignment beam mounting bracket 42 (FIG. 9). The distance between the fulcrum casting/base and the back of the rear anchor once assembled, which corresponds to the length of the alignment beam plus the length of the rear anchor, and corresponds to the distance between the fulcrum base and the butt end of a diving board on the stand, is typically between about 40 inches (about 100 cm) and about 75 inches (190 cm), such as between about 55 inches (140 cm) and 70 inches (180 cm) for some models adapted for use with some boards, and between about 45 inches (115 cm) and 55 inches (140 cm) for other models adapted for use with other boards. For example, current models have an assembled distance between the fulcrum casting/base and the back of the rear anchor of about 49 inches (about 125 cm), about 59 inches (150 cm), or about 64 inches (163 cm), plus or minus about 10%.

Figure 19:
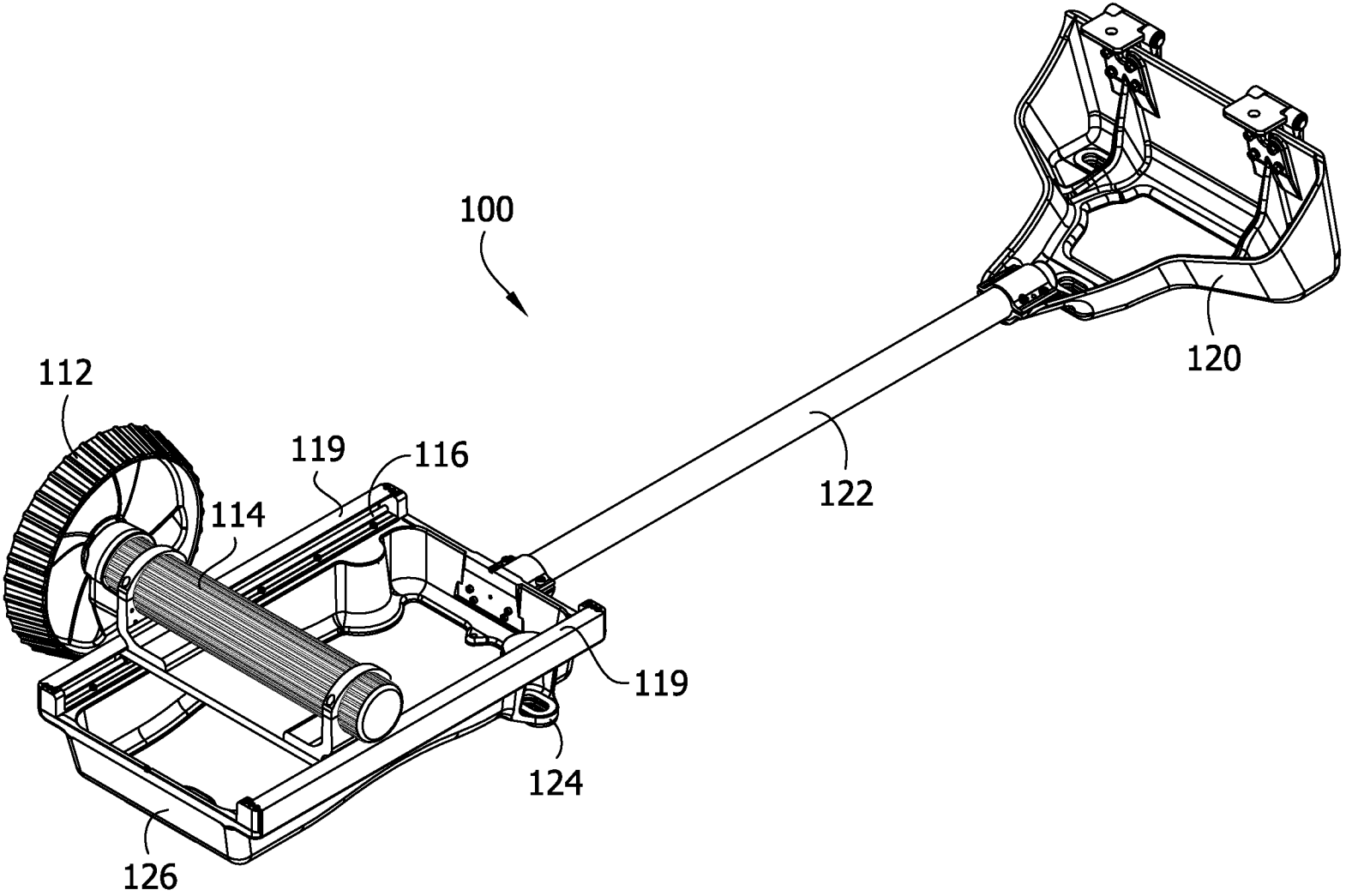
FIG. 19 is a perspective view of an alternative embodiment of the diving board stand of the invention.
Figure 20:
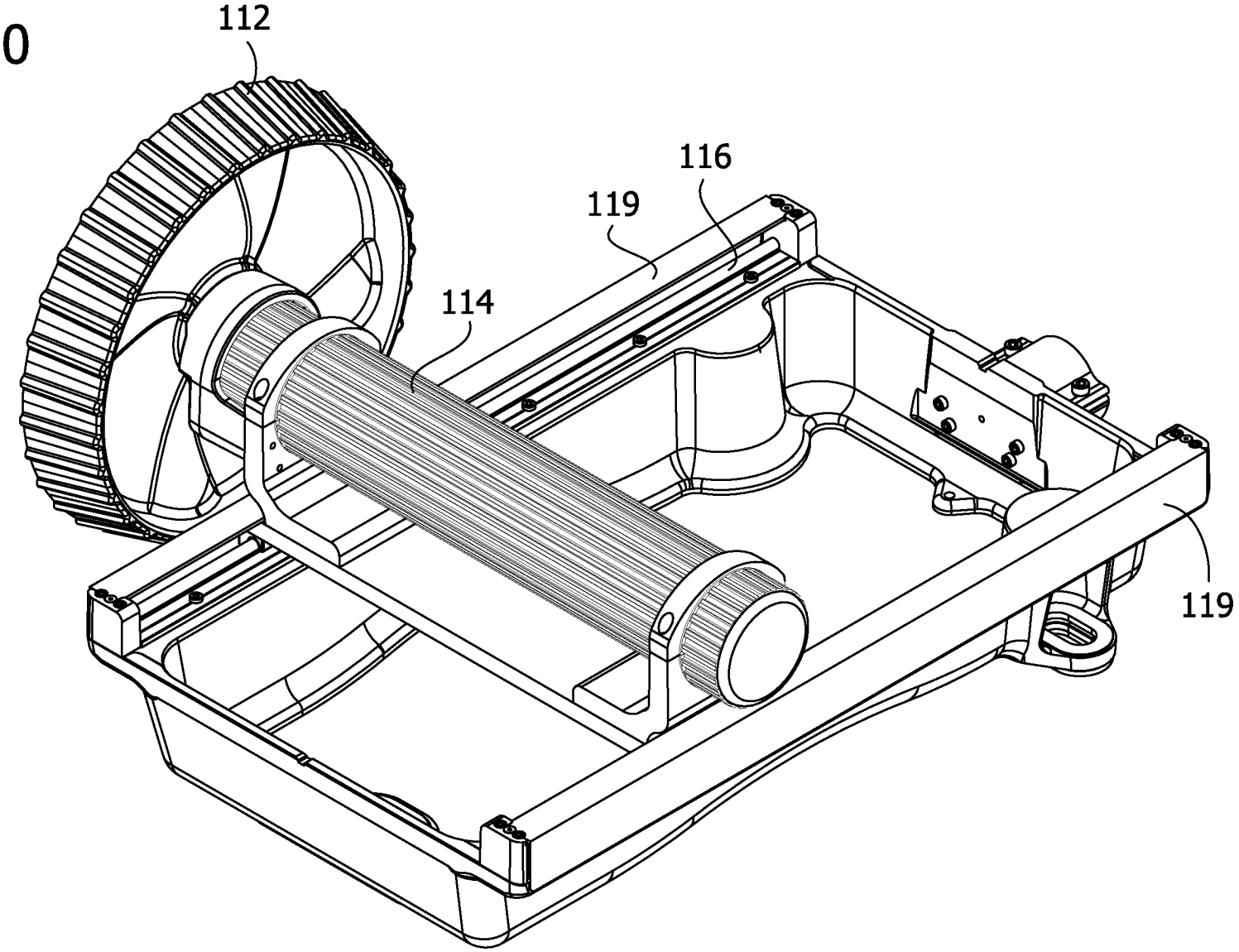
FIG. 20 is a perspective view of the fulcrum casting and fulcrum roller components of the diving board stand of FIG. 19.
Figure 21:
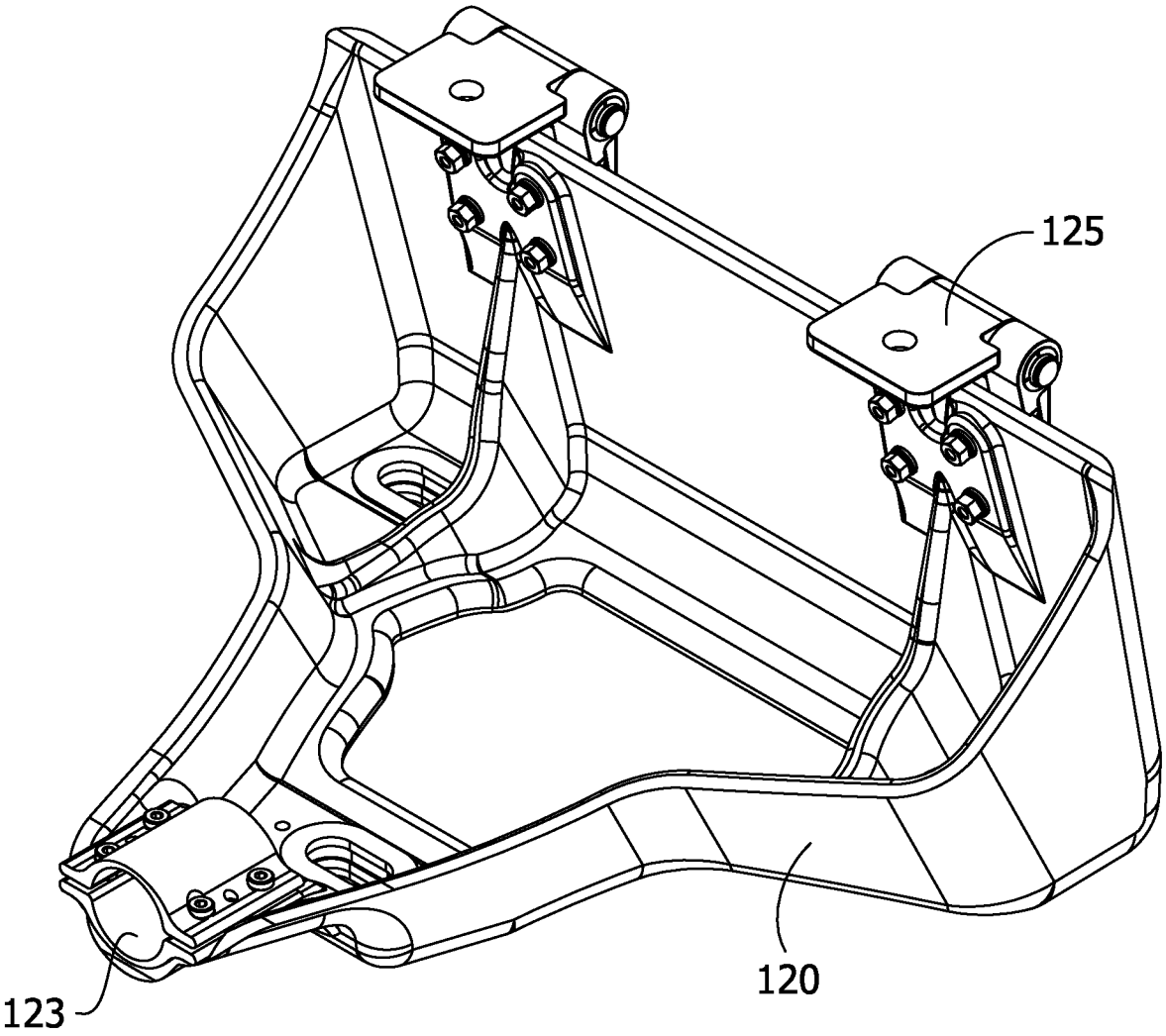
FIG. 21 is a perspective view of the anchor component of the diving board stand of FIG. 19.

A second embodiment of the diving board is depicted at 100 in FIG. 19, with components thereof depicted in FIGS. 20-25. As with the first embodiment, there is an adjustment actuator 112, a fulcrum roller 114, a linear track 116, a rear anchor 120, and alignment beam 122. Whereas the adjustment actuator 12 in the first embodiment is connected directly to the fulcrum roller 14, in the second embodiment communication between the adjustment actuator 112 and fulcrum roller 114 is through internal gearing, and there is not direct firm connection between actuator 112 and roller 114. This internal gearing reduces force required to move the actuator for adjustment of the fulcrum. It will be appreciated that the actuator is also appropriately characterized as a footwheel, since it will typically be operated by a diver's foot.

As seen in FIG. 19, the linear track consists of one rail per side, rather than two rails or vertical track elements per side with track 16 of the first embodiment. The guides 121 shown in FIG. 23 ride on the single rails. The linear track is protected from the elements and rigors of the diving environment by track cover 119, seen best in FIG. 20.

Figure 22:
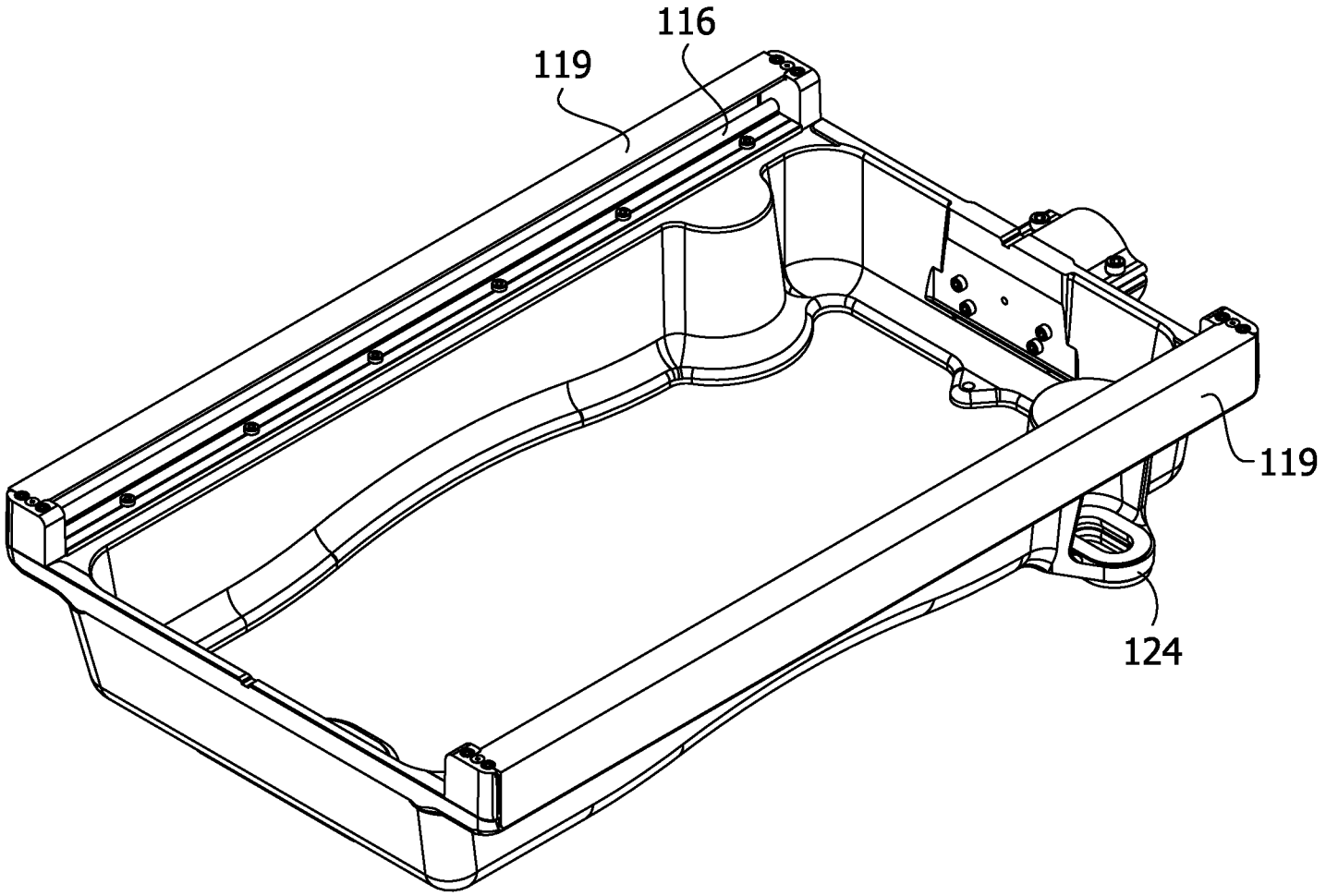
FIG. 22 is a perspective view of the fulcrum casting of the stand of FIG. 19 without the accompanying fulcrum roller and carriage assembly.
Figure 23:
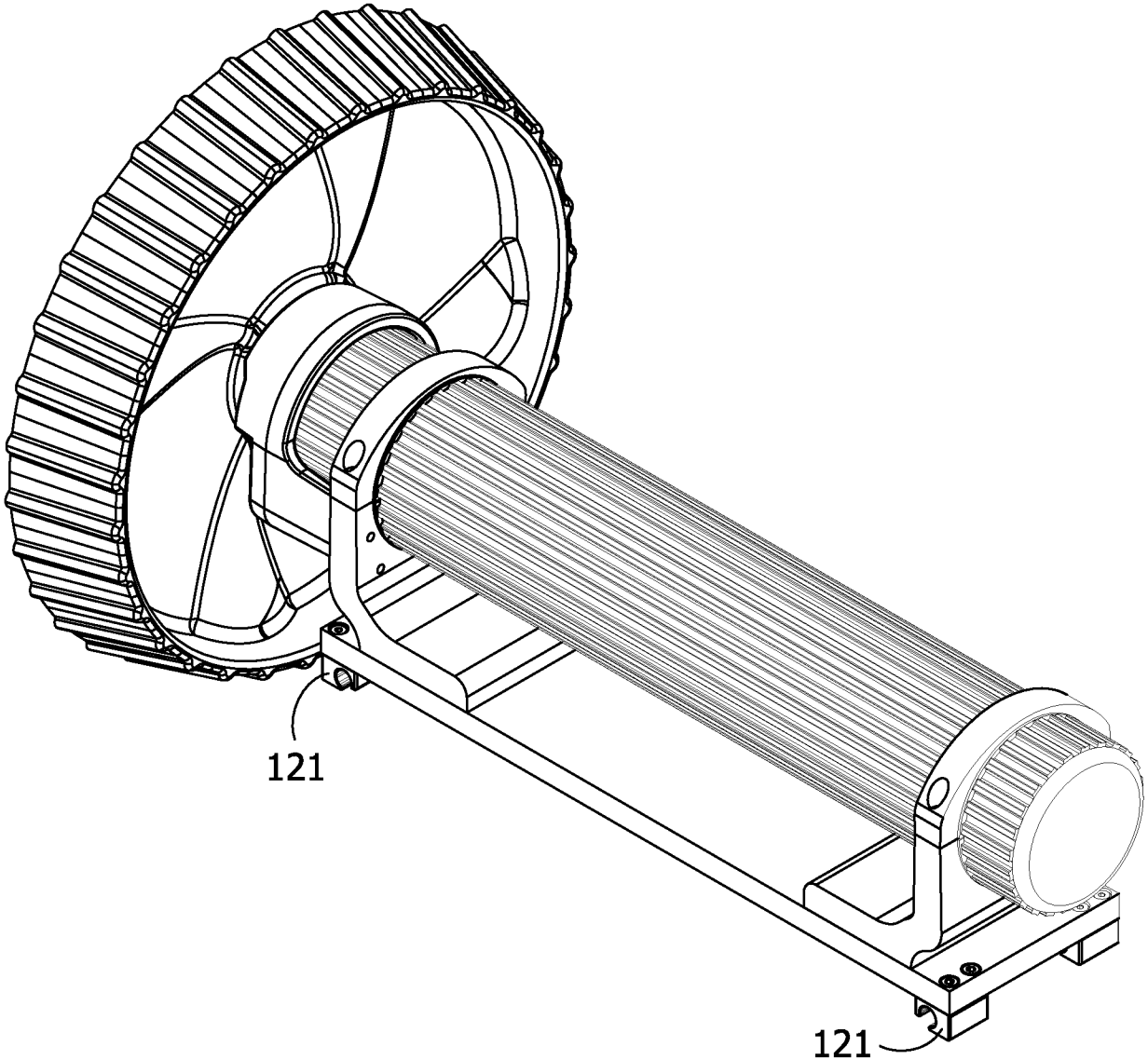
FIG. 23 is a perspective view of the fulcrum roller and fulcrum carriage assembly of the stand of FIG. 19.
Figure 24:
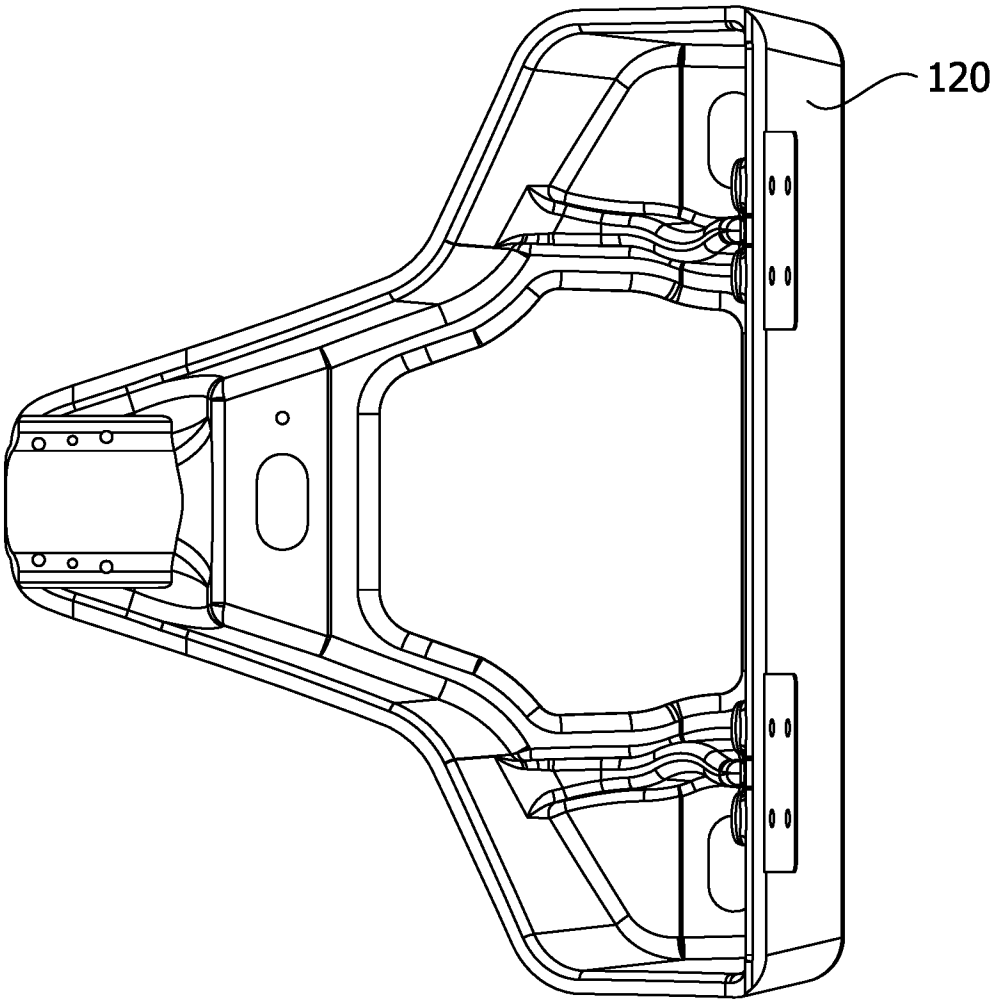
FIG. 24 is a top view of the anchor of the stand of FIG. 19.
Figure 25:
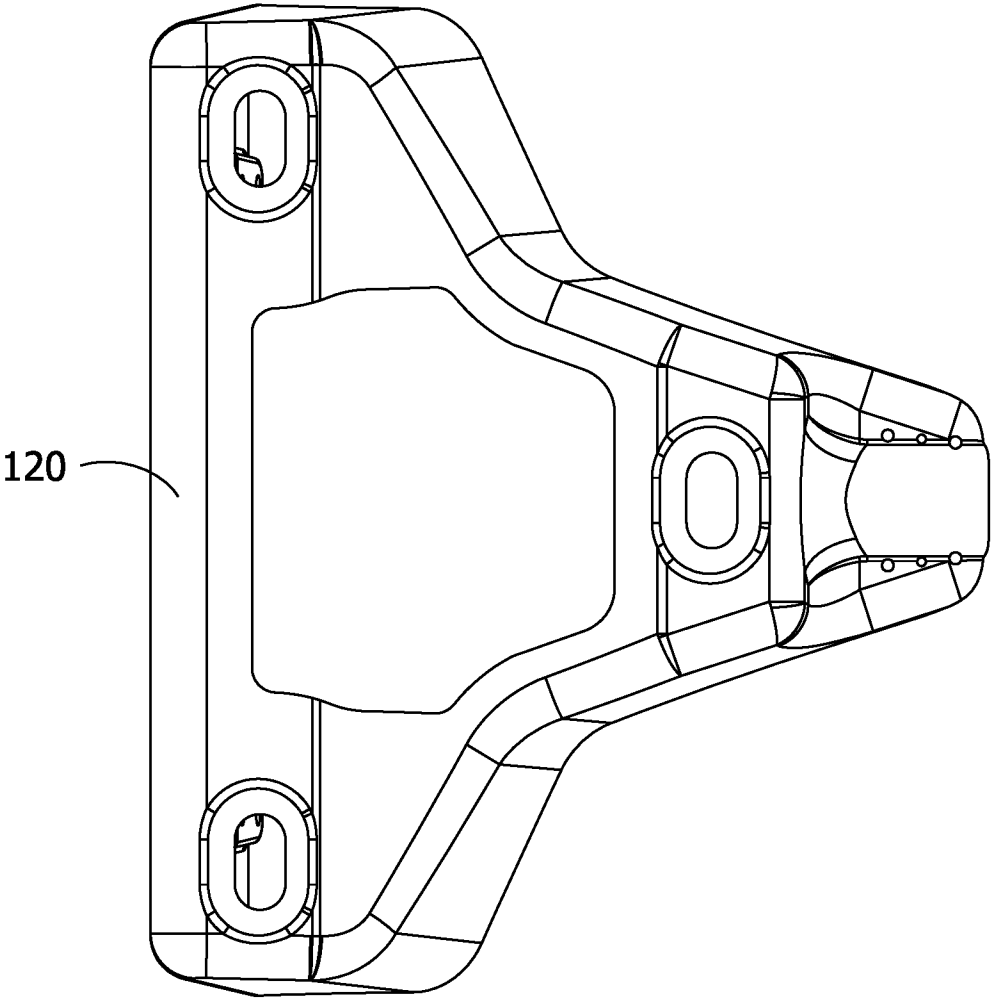
FIG. 25 is a bottom view of the anchor of the stand of FIG. 19.

There is a cast-in wing formation 124 shown in FIG. 22 extending from the fulcrum casting or fulcrum base 126 to provide a point of attachment for mounting the stand to a pedestal or platform. In attaching either embodiment of the stand to a pedestal or platform, it has been discovered that corrosion of the stand can be significantly reduced by electrically isolating the stand from the pedestal or platform. In particular, concrete around swimming pools carries current which carrying is exacerbated by rebar or other metal reinforcement in the concrete, thus putting diving board stands in electrical communication with swimming pool water. Diving board stands are therefore vulnerable to corrosion. The invention therefore optionally involves electrically isolating the stand from the platform or pedestal to which it is attached. That is, the stand optionally further comprises an electrically insulating polymer composition and/or electrically insulating washers incorporated with bolts to connect the wing formations 24/124 to the pedestal or platform.

In the second embodiment, the central opening in rear anchor 120 is larger than in the first embodiment. This larger opening is large enough to provide manual access with a torque wrench to verify tightness of connections including mounting bolts. The opening in a currently preferred embodiment is therefore defined by a minimum vertical dimension in the longitudinal direction of the stand and its alignment beam of at least about 3.3 inches (8.3 cm), and a minimum horizontal dimension of at least about 2.3 inches (5.8 cm). This allows for proper arc swing of the wrench and proper clearance to get the wrench onto and off of connecting bolts. The rear anchor therefore comprises an opening having at least one vertical dimension in the longitudinal direction of the stand that is at least about 8.3 cm and at least one horizontal dimension of at least about 5.8 cm to provide access to connections between the anchor and a diving board. As with the first embodiment, the rear anchor is a brace for connecting and anchoring the assembly to a diving board and preferably comprises a tray 123 (FIG. 21) into which the end of the alignment beam 22 nests, and two or more hinges 125 which function with connectors such as bolts to fix the diving board to the anchor, while allowing the diving board to pivot up and down.

The diving board stand of the invention manifests significant improvements in various aspects, such as in the areas of maintenance and repeatability. In one respect, the stand employs bearing surface interfaces that do not require added lubrication. There is also reduction in the required alignment adjustments for the fulcrum to operate smoothly. In the stand of the invention, the the track system is less vulnerable to what is known as racking which can occur when twisting of the fulcrum tie plate locks the fulcrum in place. This is twisting is abated by components which maintain alignment. These components also reduce rattling noises. The design uses a track system that allows for the fulcrum carriage to overcome this racking while not needing the extra components and lubrication. This advantageously increases the repeatability as the system is not reliant on maintaining its alignment via quickly decaying components and lubrication. It can further be appreciated that the communication manifest in the connection among the fulcrum casting, alignment beam, and anchor has a stabilizing influence from which various benefits may flow.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained. As various changes could be made in the above products and methods without departing from the scope of the invention, it is intended that all matter contained in the above description and shown in the accompanying drawings shall be interpreted as illustrative and not in a limiting sense.

The invention claimed is:

1. A diving board stand comprising:

a fulcrum base;

a fulcrum roller configured to be supported over the fulcrum base and movable on the fulcrum base;

a rear anchor for connecting the diving board stand to a rear end of a diving board; and an alignment beam for connecting the fulcrum base to the rear anchor;

wherein the fulcrum base comprises a first portion for attaching to the alignment beam and a second portion defining a mounting point for securing the fulcrum base directly to a pedestal or platform;

wherein the rear anchor supports one end of the alignment beam.

2. The diving board stand of claim 1 wherein the rear anchor comprises a tray for receiving an end of the alignment beam.

3. The diving board stand of claim 2 wherein the fulcrum base comprises vertically projecting rails for guiding the fulcrum roller.

4. The diving board stand of claim 1 wherein the fulcrum base comprises vertically projecting rails for guiding the fulcrum roller.

5. The diving board stand of claim 1 further comprising a fulcrum carriage that supports the fulcrum roller on the fulcrum base.

6. The diving board stand of claim 4 further comprising a fulcrum carriage that supports the fulcrum roller on the fulcrum base.

7. The diving board stand of claim 6 wherein the fulcrum carriage comprises guides which ride on the vertically projecting rails of the fulcrum base for guiding the fulcrum along the fulcrum base.

8. The diving board stand of claim 4 wherein the vertically projecting rails consist of two tracks.

9. The diving board stand of claim 4 wherein the fulcrum base comprises covers for shielding the vertically projecting rails.

10. A diving board stand comprising:

a fulcrum base having opposite left and right side portions;

a fulcrum roller configured to be supported over the fulcrum base and movable on the fulcrum base, the fulcrum roller having a left end portion and an opposite right end portion, the left end portion configured to be supported above the left side portion of the fulcrum base and the right end portion being configured to be supported above the right side portion of the fulcrum base;

a fulcrum carriage for supporting the fulcrum roller on the fulcrum base;

a rear anchor for connecting the diving board stand to a rear end of a diving board, the rear anchor having opposite left and right side portions; and a single alignment beam for connecting the fulcrum base to the rear anchor;

wherein:

the rear anchor comprises hinges for hingedly securing a diving board to the rear anchor;

the fulcrum base comprises vertically projecting rails; and the fulcrum carriage comprises guides for riding on the vertically projecting rails of the fulcrum base for guiding the fulcrum along the fulcrum base; and wherein the alignment beam has a front end portion received in the fulcrum base at a location spaced apart between the left and right side portions of the fulcrum base and a rear end portion received in the rear anchor at a location spaced apart between the left and right side portions of the rear anchor.

11. A diving board stand comprising:

a fulcrum base having a front end portion and a rear end portion spaced apart along the longitudinal axis;

a fulcrum roller configured to be supported over the fulcrum base and movable on the fulcrum base along the longitudinal axis;

a rear anchor for connecting the diving board stand to a rear end of a diving board, the rear anchor comprising a front end portion and a rear end portion spaced apart along the longitudinal axis; and an alignment beam for connecting the fulcrum base to the rear anchor, the alignment beam having a front end portion and a rear end portion spaced apart along the longitudinal axis;

wherein the rear end portion of the fulcrum base is configured to receive the front end portion of the alignment beam and the front end portion of the rear anchor is configured to receive the rear end portion of the alignment beam such that the alignment beam is supported on the fulcrum base and the rear anchor, the fulcrum base defines a front end of the diving board stand, the rear anchor defines a rear end of the diving board stand, the front end portion of the alignment beam is spaced apart from the front end of the diving board stand toward the rear end of the diving board stand, and the rear end portion of the alignment beam is spaced apart from the rear end of the diving board stand toward the front end of the diving board stand.

* * * * *